US008640364B2

(12) United States Patent
Arzberger et al.

(10) Patent No.: US 8,640,364 B2
(45) Date of Patent: Feb. 4, 2014

(54) CUTTING DEVICE FOR PRODUCING VERTICALLY RUNNING TRENCHES IN THE GROUND

(75) Inventors: Maximilian Arzberger, Igenhausen (DE); Ignaz Seitle, Karlshuld (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 417 days.

(21) Appl. No.: 13/071,160

(22) Filed: Mar. 24, 2011

(65) Prior Publication Data

US 2011/0253450 A1 Oct. 20, 2011

(30) Foreign Application Priority Data

Apr. 16, 2010 (EP) ..... 10004083

(51) Int. Cl.
*E02F 3/24* (2006.01)

(52) U.S. Cl.
USPC ..... 37/189

(58) Field of Classification Search
USPC ..... 37/91, 189, 364, 352, 468, 365, 94; 175/91, 96; 299/75, 106; 405/263, 266, 405/267
See application file for complete search history.

(56) References Cited

U.S. PATENT DOCUMENTS

| | | | | |
|---|---|---|---|---|
| 3,894,587 | A * | 7/1975 | Sourice | 175/91 |
| 4,629,010 | A * | 12/1986 | Sourice | 175/57 |
| 4,744,425 | A | 5/1988 | Hentschel | |
| 4,800,967 | A * | 1/1989 | Chagnot et al. | 175/96 |
| 5,056,242 | A | 10/1991 | Miotti | |
| 5,263,798 | A | 11/1993 | Dupeuble et al. | |
| 6,164,873 | A | 12/2000 | Miotti et al. | |
| 7,367,143 | B2 * | 5/2008 | Stoetzer | 37/189 |
| 7,661,209 | B2 * | 2/2010 | Arzberger et al. | 37/189 |
| 8,020,323 | B2 * | 9/2011 | Chagnot et al. | 37/189 |
| 2006/0037218 | A1 | 2/2006 | Stoetzer | |
| 2009/0031590 | A1 | 2/2009 | Arzberger et al. | |

FOREIGN PATENT DOCUMENTS

| | | | |
|---|---|---|---|
| DE | 3602387 | C1 | 6/1987 |
| DE | 10 2005 059 824 | B3 | 6/2007 |
| DE | 102007035591 | B3 | 10/2008 |
| EP | 0109907 | A2 | 5/1984 |
| EP | 0496926 | A1 | 8/1992 |
| EP | 0 580 264 | A1 | 1/1994 |
| EP | 0802286 | A2 | 10/1997 |
| EP | 1 630 301 | A1 | 3/2006 |

(Continued)

OTHER PUBLICATIONS

Arturo Ressi De Cervia, "The Deep Cut-Off at the Walter F George Dam", Deep Foundations, Fall 2004, pp. 4-9, Deep Foundations Institute, Hawthorne, NJ.

(Continued)

*Primary Examiner* — Robert Pezzuto
(74) *Attorney, Agent, or Firm* — Studebaker & Brackett PC

(57) ABSTRACT

A cutting device for producing vertically running trenches in the ground includes a trench wall cutter which has a cutting frame, a first cutting wheel arrangement and a second cutting wheel arrangement. The cutting wheel arrangements are arranged adjacent to each other on the underside of the cutting frame in order to remove ground material underneath the cutting frame. The trench wall cutter has an adjusting mechanism, with which the first cutting wheel arrangement is adjustable in a direction lying obliquely underneath the second cutting wheel arrangement.

14 Claims, 4 Drawing Sheets

(56) References Cited

FOREIGN PATENT DOCUMENTS

| | | | |
|---|---|---|---|
| EP | 1 640 509 | A1 | 3/2006 |
| FR | 2565290 | A1 | 12/1985 |
| FR | 2579265 | A1 | 9/1986 |
| JP | 54-90802 | A | 7/1979 |
| JP | 58-156630 | A | 9/1983 |
| JP | 62-45831 | A | 2/1987 |
| JP | H4-185817 | A | 7/1992 |
| JP | H6-116959 | A | 4/1994 |
| JP | H6-35332 | U | 12/1994 |
| JP | H8-199575 | A | 8/1996 |
| JP | H8-218379 | A | 8/1996 |
| JP | H8-218422 | A | 8/1996 |
| RU | 2304199 | C2 | 8/2007 |
| RU | 2310725 | C2 | 11/2007 |
| SU | 1461822 | A1 | 2/1989 |
| SU | 1573106 | A1 | 6/1990 |

OTHER PUBLICATIONS

Col Robert B. Keyser, "2004 CERF Charles Pankow Award for Innovation", Jan. 31, 2004, pp. 1-8, Army Corps of Enginners, Mobile District, Mobile, AL.

H. Geiger; "European Search Report"; EP10004083; Jun. 11, 2010.

* cited by examiner

CUTTING DEVICE FOR PRODUCING VERTICALLY RUNNING TRENCHES IN THE GROUND

FIELD OF THE INVENTION

The invention relates to a cutting device for producing vertically running trenches in the ground in accordance with the preamble of claim 1. Such a cutting device is designed with a trench wall cutter, which has a cutting frame, a first cutting wheel arrangement and a second cutting wheel arrangement, whereby the cutting wheel arrangements are arranged adjacent to each other on the underside of the cutting frame in order to remove ground material underneath the cutting frame.

BACKGROUND

A generic cutting device is known from EP 0 802 286 A2 for example. In this known cutter the cutting wheels are pivotable about an axis running perpendicularly to the cutting wheel axes in order to produce trenches that are enlarged in some areas.

Further trench wall cutters with pivotable cutting wheels are known from DE 36 02 387 C1, EP 0 496 926 A1, EP 0 109 907 A2, FR 2 565 290 A1 and FR 2 579 265 A1.

The object of the invention is to provide a cutting device, which is especially versatile in use whilst featuring a particularly high reliability.

The object is solved in accordance with the invention by a cutting device having the features of claim 1. Preferred embodiments are stated in the dependent claims.

The cutting device according to the invention is characterized in that the trench wall cutter has an adjusting means with which the first cutting wheel arrangement is adjustable in a direction lying obliquely underneath the second cutting wheel arrangement.

A fundamental idea of the invention can be seen in the fact that the first cutting wheel arrangement is provided in an adjustable manner relative to the cutting frame and to the second cutting wheel arrangement. According to the invention the first cutting wheel arrangement is adjustable in a direction lying obliquely underneath the second cutting wheel arrangement, i.e. the adjusting movement that can be brought about with the adjusting means has a vertical component in the downward direction on the one hand and, in addition, also a horizontal component in the direction towards the second cutting wheel arrangement. For instance provision can be made for the first cutting wheel arrangement to be adjustable by the adjusting means on a curved path surrounding the second cutting wheel arrangement. In particular, the adjusting means according to the invention can be designed such that this curved path runs in a plane which extends perpendicularly to the axis of rotation of the first cutting wheel arrangement and/or the second cutting wheel arrangement.

The adjusting means according to the invention renders it possible to produce an oblique removal surface. Moreover, through the oblique displacement of the first cutting wheel arrangement beneath the second cutting wheel arrangement an overlapping of the cutting cross-sections of the two cutting wheel arrangements can be brought about so that in addition an increase of the superimposed load is rendered possible that can be advantageous e.g. in the case of especially hard ground material.

With regard to the constructional work involved it is especially advantageous for the adjusting means to have at least one steering bar, through which the first cutting wheel arrangement is connected to the cutting frame. By means of such a steering bar the adjustment path into an area located obliquely underneath the second cutting wheel arrangement, as provided according to the invention, can be predetermined in an especially simple and reliable manner. In particular, provision can be made for the adjusting means to have two parallel running steering bars, through which the first cutting wheel arrangement is connected to the cutting frame. As a result, a four-bar linkage can be formed which, whilst being of especially high reliability and requiring a minimum of constructional work, allows the adjustment path provided in accordance with the invention to be realized in a particularly easy way. More particularly, the parallelogram-like shifting of a four-bar linkage also has the effect that the axes of rotation of the two cutting wheel arrangements always have approximately the same distance during shifting. In this way, non-removed ridges of ground material are prevented from remaining between the cutting wheels, on which the trench wall cutter might run aground. For best suitability, the axes of articulation of the at least one steering bar, in particular the axes of articulation of the two parallel steering bars, run parallel to the axes of rotation of the cutting wheel arrangements. The four-bar linkage according to the invention can also be referred to as a coupling rocker.

For an especially precise production of trenches it can be of advantage that on a guide side of the trench wall cutter the cutting frame has at least one guide means for guiding the cutting frame on a guide pole. In this way, a guided trench wall cutter is obtained that can be guided during lowering into the ground on a guide pole running in particular in the vertical direction.

The guide means can have at least one guide shoe for example. In particular, provision can be made for the guide means to have at least two guide shoes arranged on top of each other, whereby jamming is counteracted. By preference, the at least one guide shoe can have an undercut that embraces a guide rail on the guide pole. The guide shoes can, in particular, be designed as slide shoes or as roller guide shoes.

It is especially useful for the adjustable first cutting wheel arrangement to be arranged closer to the guide side than the second cutting wheel arrangement. Hence, according to this embodiment the cutting wheel arrangement, which is adjustable by means of the adjusting means, faces towards the guide side while the second cutting wheel arrangement faces away from the guide side. In this embodiment the first cutting wheel arrangement located adjacent to the guide pole can be moved away from the said guide pole by means of the adjusting means. This, in turn, makes it possible to use guide poles with a widened pole foot, since the adjusting means enables the first cutting wheel arrangement to be moved away from this pole foot so that cutting into the pole foot is prevented.

If a guide means is present, according to the invention it can be that a guide pole is provided, on which the trench wall cutter is guided by means of the guide means. Thus, the cutting device can also comprise the guide pole.

In particular, provision can be made for the guide pole to have at least one conveyor line for conveying ground material that is removed by the cutting wheel arrangements. According to this embodiment the guide pole assumes a double function in that it guides the cutter on the one hand and also serves for conveying ground material away from the cut trench on the other hand. The conveyor line can run inside the guide pole for example. In that case the guide pole can have e.g. in its outer surface at least one passage opening, through which the ground material can pass into the conveyor line.

In accordance with the invention the first cutting wheel arrangement has at least one first cutting wheel and the second cutting wheel arrangement has at least one second cutting wheel. For the production of trenches it is particularly advantageous for the axes of rotation of the first and second cutting wheels to run parallel to each other.

It is especially preferred that the first cutting wheel and the second cutting wheel have the same cutting direction. This can be considered as an independent aspect of the invention that can also be realized without the adjusting means. According to the invention the cutting direction can be understood with respect to a side view of the trench wall cutter. For example provision can be made that on rotation all cutting wheels cut in the clockwise direction, when seen from a side view of the cutter, or that all cutting wheels cut in the anti-clockwise direction from a same such view. Such an identical cutting direction is especially advantageous if the removed drill spoil is conveyed in a decentralized way, for example on the guide pole. For in the case of an identical cutting direction all cutting wheels convey the removed ground material into the same direction during cutting operation, by preference towards the decentralized place of discharge.

For an especially good cutting effect provision can be made for the first cutting wheel arrangement to have a first cutting wheel pair with two coaxially arranged first cutting wheels and for the second cutting wheel arrangement to have a second cutting wheel pair with two coaxially arranged second cutting wheels. For instance the two cutting wheel arrangements can have a cutting shield each, on both sides of which a cutting wheel is arranged in each case. For the reasons mentioned above a common cutting direction can also be advantageous for cutting wheel pairs. In particular, it is therefore preferred that in side view of the trench wall cutter the cutting wheels of the first cutting wheel pair and the cutting wheels of the second cutting wheel pair all have the same cutting direction.

It is especially useful that on rotation in the cutting direction the cutting wheels convey ground material on their underside towards the guide side. In accordance with this embodiment the cutting wheels not only serve for cutting but during cutting they also convey the removed ground material towards the guide side and therefore towards the conveyor line of the guide pole running on the guide side.

With regard to the constructional work involved it is especially advantageous for the trench wall cutter to be suspended on a cable suspension. With this cable suspension the trench wall cutter can be lowered into the ground and retracted again from the trench produced in the ground. The lateral guidance, which by means of a cable suspension alone can often only be realized to a limited extent, can, in accordance with the invention, be guaranteed especially by reason of the guide means and the guide pole.

According to the invention provision can be made for the second cutting wheel arrangement, i.e. in particular the cutting wheel arrangement located further away from the guide mast, to be arranged in a fixed manner on the cutting frame, i.e. in contrast to the first cutting wheel arrangement it is not adjustable relative to the cutting frame. This permits an especially reliable guidance along the trench.

In order to ensure a particularly reliable driven adjustment of the first cutting wheel arrangement it is useful for the adjusting means to have at least one hydraulic cylinder. The adjusting means can then also be referred to as hydraulic adjusting means. By preference, the hydraulic cylinder is articulated on the one hand to the cutting frame and on the other hand to the first cutting wheel arrangement. For an especially compact construction along with a minimum amount of force expenditure the point of articulation of the hydraulic cylinder on the cutting frame is suitably provided above the point of articulation of the hydraulic cylinder on the cutting wheel arrangement. In particular, the hydraulic cylinder can run at least approximately in the vertical direction.

For example the first cutting wheel arrangement can have an auxiliary frame which runs above the at least one cutting wheel of the first cutting wheel arrangement and to which the hydraulic cylinder and/or the at least one steering bar is articulated.

Another preferred embodiment of the invention resides in the fact that on the cutting frame at least one extendable flap for securing the trench wall cutter on a wall of the trench is provided. Such an extendable flap allows the trench wall cutter to be pressed against the wall of the trench so that a vertical movement of the trench wall cutter is prevented due to the resultant wall fric-tion. As soon as the cutting frame with extended flap is secured the adjusting means can be actuated for example and in doing so the first cutting wheel arrangement can be loaded. As a result, a configuration can be achieved, in which a superimposed load is only present on one of the two cutting wheel arrangements, namely the first cutting wheel arrangement.

With regard to operational reliability it is particularly advantageous for the extendable flap to be connected to the cutting frame via two parallel running flap steering bars. More particularly, a four-bar linkage can be formed in this way which permits adjustment of the flap. Accordingly, the axes of articulation of the flap steering bars suitably run parallel to each other.

To ensure an especially reliable operation of the trench wall cutter it can be of advantage that at least two extendable flaps for securing the trench wall cutter on a wall of the trench are provided. In particular, it can be advantageous for both flaps to be extendable in directions running perpendicularly to each other. For instance the first flap can be extended perpendicularly to the axes of rotation of the cutting wheel arrangements and the second flap can be extended in the direction of these axes of rotation.

The invention also relates to a method for producing a vertically running trench in the ground, in which the cutting wheel arrangements of the trench wall cutter of a cutting device according to the invention are put into operation and the trench wall cutter is introduced into the ground.

BRIEF DESCRIPTION OF THE DRAWINGS

In the following the invention is explained in greater detail by way of preferred embodiments illustrated schematically in the accompanying Figures, wherein show.

DETAILED DESCRIPTION

Figure 1:
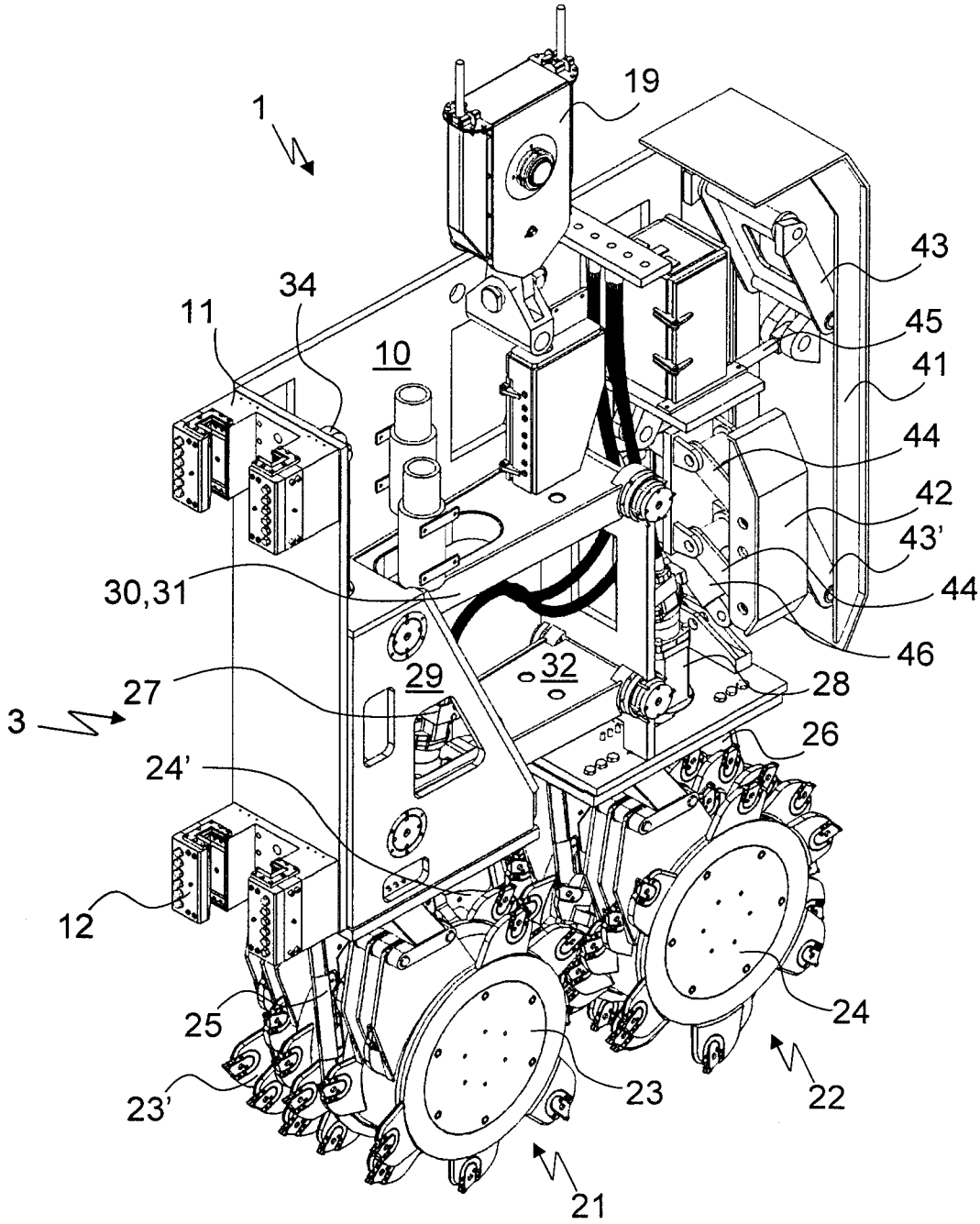
FIG. 1 a perspective view of a trench wall cutter of a cutting device according to the invention.
Figure 2:
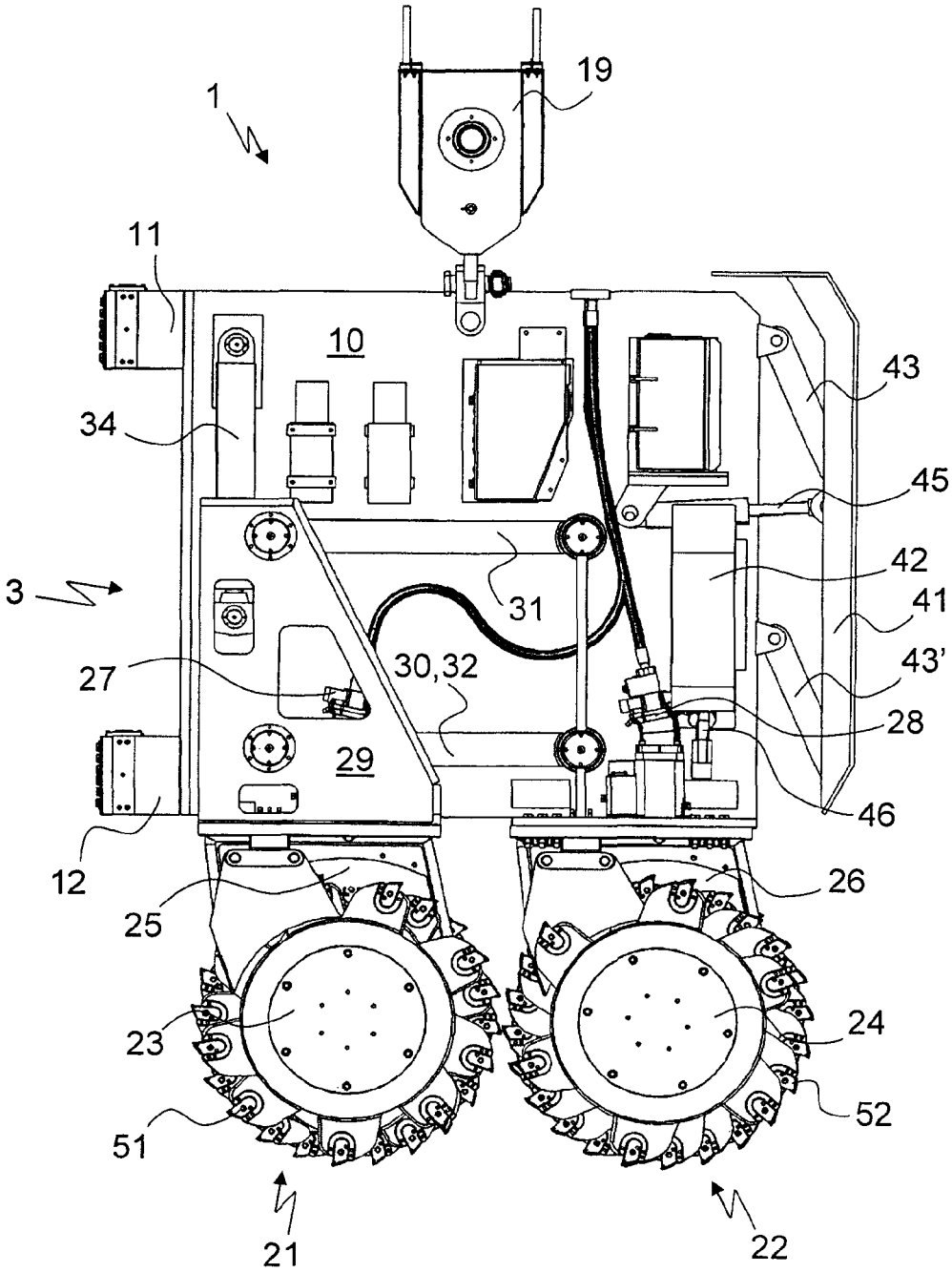
FIG. 2 a side view of the trench wall cutter of FIG. 1 with the first cutting wheel arrangement being located in a neutral position.
Figure 3:
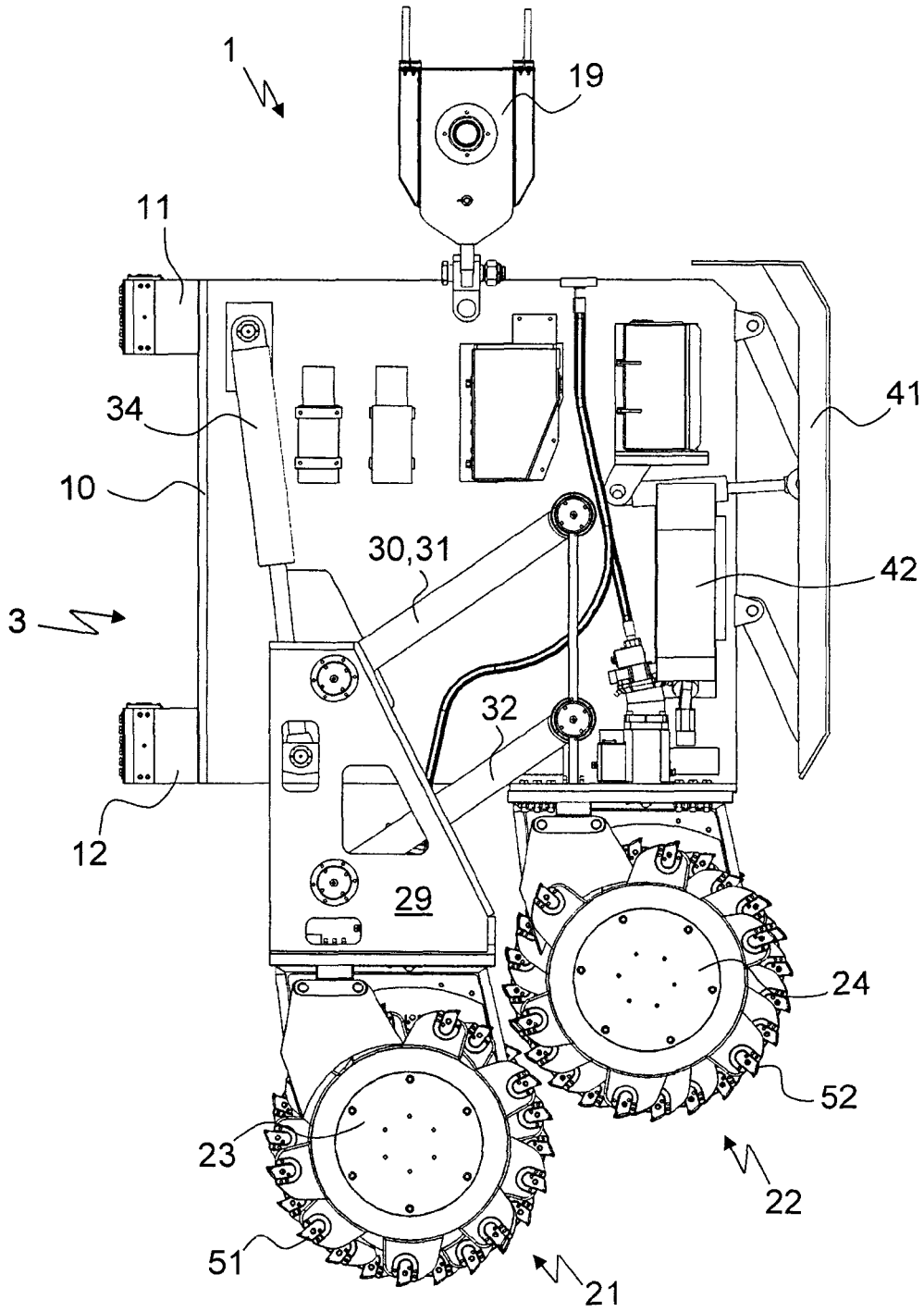
FIG. 3 the view of FIG. 2 with extended first cutting wheel arrangement.

A trench wall cutter 1 according to the invention for a cutting device according to the invention is shown in FIGS. 1 to 3. The trench wall cutter 1 has a box-shaped cutting frame 10 and is suspended on a cable suspension 19 on the upper side of the cutting frame 10. On the underside of the cutting frame 10 two cutting wheel arrangements 21, 22 are provided. The cutting wheel arrangements 21, 22 are therefore arranged in the advance direction on the cutting frame 10.

As can be seen in FIG. 1 in particular, the first cutting wheel arrangement 21 has a cutting shield 25 directed perpendicularly downwards, on both sides of which a cutting wheel 23 and 23' respectively is arranged in each case. The two cutting wheels 23, 23' of the first cutting wheel arrangement 21 are designed coaxially to each other having a common horizontally running axis of rotation. In analogy to the first cutting wheel arrangement 21, the second cutting wheel arrangement 22 also has a perpendicularly downward running second cutting shield 26, on both sides of which a second cutting wheel 24 and 24' respectively is arranged in each case. Likewise, the second cutting wheels 24, 24' are also designed coaxially to each other having a common horizontally running axis of rotation. The axes of rotation of the first cutting wheels 23, 23' and the second cutting wheels 24, 24' run parallel to each other.

For rotating actuation of the first cutting wheels 23, 23' the first cutting wheel arrangement 21 has a first drive motor 27, which is arranged above the cutting shield 25. By analogy, for rotating actuation of the second cutting wheels 24, 24' the second cutting wheel arrangement 22 has a second drive motor 28, which is arranged above the second cutting shield 26.

Furthermore, the first cutting wheel arrangement 21 has an auxiliary frame 29 which is approximately triangular in outline in the side view of FIGS. 2 and 3. This auxiliary frame 29 is movable with respect to the cutting frame 10. On the underside of the auxiliary frame 29 the first cutting shield 25 is fixed. Moreover, on the auxiliary frame 29 the drive motor 27 of the first cutting wheel arrangement 21 is arranged.

The second cutting wheel arrangement 22 is provided in a fixed manner on the cutting frame 10. In contrast, the first cutting wheel arrangement 21 is adjustable by means of an adjusting means 30 relative to the cutting frame 10 and therefore to the second cutting wheel arrangement 22, in which case the function of the adjusting means 30 is apparent, in particular, from a comparison of FIGS. 2 and 3. The adjusting means 30 has two parallel running steering bars 31 and 32 that are articulated on the one hand (right side in FIGS. 2 and 3) to the cutting frame 10 and on the other hand (left side in FIGS. 2 and 3) to the first cutting wheel arrangement 21, namely to its auxiliary frame 29. All axes of articulation of the steering bars 31 and 32 run horizontally, parallel to each other as well as parallel to the axes of rotation of the cutting wheels 23, 24. As a result of the arrangement of the steering bars 31, 32 a four-bar linkage is present, in which the first link is formed by the first steering bar 31, the second link by the cutting frame 10, the third link by the second steering bar 32 and the fourth link by the auxiliary frame 29. As shown in FIGS. 2 and 3, this four-bar linkage enables the first cutting wheel arrangement 21 to be displaced on a defined path relative to the cutting frame 10 and therefore relative to the second cutting wheel arrangement 22, whereby along this path the first cutting wheel arrangement 21 can attain a position obliquely underneath the second cutting wheel arrangement 22. The path preset by the four-bar linkage of the adjusting means 30 is designed such that during the displacement motion the axis of the first cutting wheels 23 approximately maintains the distance to the axis of the second cutting wheels 24. During the displacement motion caused by the adjusting means 30, as depicted in FIG. 3, an overlapping of the cutting cross-sections of the cutting wheels 23 and 24 can occur.

As is also shown in FIGS. 2 and 3 in particular, the adjusting means 30 furthermore has a linear drive designed as a hydraulic cylinder 34. This hydraulic cylinder 34 runs approximately perpendicularly and is articulated on the one hand above the auxiliary frame 29 to the cutting frame 10 and on the other hand to the auxiliary frame 29 of the first cutting wheel arrangement 21 itself. If, as illustrated in FIG. 3, the hydraulic cylinder 34 is extended, then the first cutting wheel arrangement 21 is extended in the downward direction. If, on the other hand, the hydraulic cylinder 34 is retracted, the cutting wheel arrangement 21 is moved back towards the cutting frame 10 until the neutral position shown in FIG. 2 is reached, in which both cutting wheel arrangements 21 and 22, more particularly their axes of rotation, are located at the same height. In the neutral position both steering bars 31, 32 run horizontally, as shown in FIG. 2.

On the left side in FIGS. 1 to 3 the trench wall cutter 1 has a guide means with two guide shoes 11 and 12 that are arranged on top of each other on the cutting frame 10. The side of the cutter, on which the guide shoes 11 and 12 are arranged, can therefore also be referred to as the guide side 3. As will be set out below in greater detail with reference to FIG. 4, the guide shoes 11, 12 serve for guidance of the trench wall cutter 1 on a guide pole 70.

As is furthermore shown in FIGS. 1 to 3, the trench wall cutter 1 has on its cutting frame extendable flaps 41, 42, with which the cutting frame 10 can be secured on the wall of the produced trench. The first flap 41 is arranged on the side of the frame lying opposite the guide side 3. The second, smaller flap 42 is arranged in pairs at the front and rear of the cutting frame 10, i.e. on the side lying at the front when looking in the direction of the axes of rotation of the cutting wheels 23, 24. The first flap 41 is arranged via two parallel running flap steering bars 43, 43' on the cutting frame 10 so that the first flap 41, the flap steering bars 43, 43' and the cutting frame 10 form another four-bar linkage. By analogy, the second flap 42 is connected via two parallel running flap steering bars 44, 44' to the cutting frame 10 so that a further four-bar linkage is formed. For active extension of the first flap 41 a hydraulic cylinder 45 is provided and for active extension of the second flap 42 a hydraulic cylinder 46 is provided. Both flaps 41 and 42 can be extended in directions running perpendicularly to each other, namely the first flap 41 into a direction running perpendicularly to the axes of rotation of the cutting wheels 23, 24 and the second flap 42 into a direction running parallel to the axes of rotation.

Figure 4:
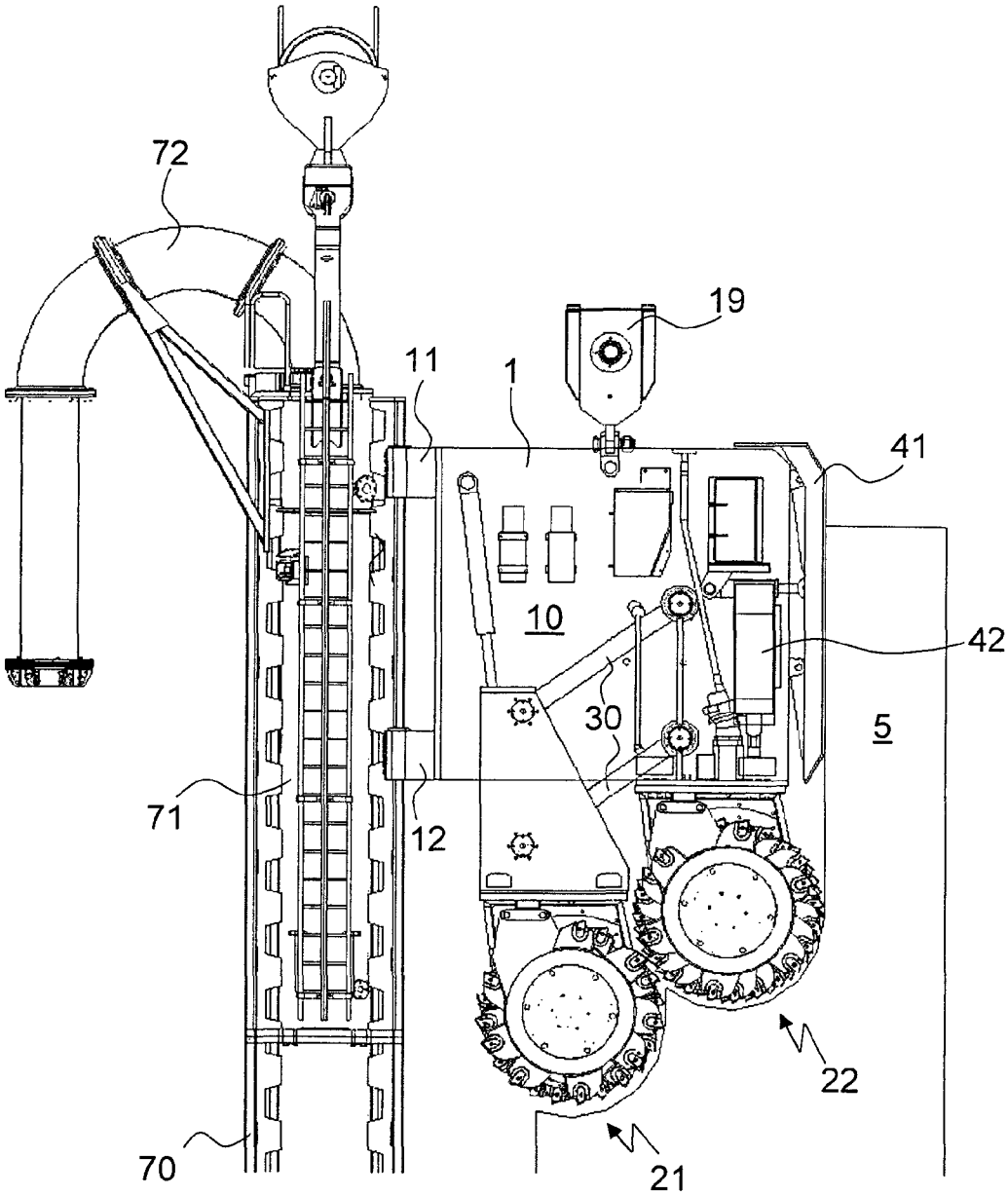
FIG. 4 a cutting device with the trench wall cutter of FIGS. 1 to 3.

FIG. 4 shows a cutting device according to the invention, in which the trench wall cutter of FIGS. 1 to 3 is arranged on a guide pole 70 whilst carrying out a method in accordance with the invention. This guide pole 70 is introduced into the ground 5 in an at least approximately perpendicular manner. To this end e.g. a drill-hole can be produced in the ground 5. The guide pole 70 can also be introduced into a trench section already produced beforehand with the trench wall cutter 1.

Via the guide means with the guide shoes 11, 12 the trench wall cutter 1 is arranged in a vertically displaceable manner on the guide pole 70 so that the said guide pole 70 predetermines the cutting direction when the trench wall cutter 1 is lowered by means of the cable suspension 19 into the ground 5. In this, the guide shoes 11, 12 embrace a rail that runs longitudinally of the guide pole 70.

As shown in FIG. 4, during lowering of the trench wall cutter 1 the first cutting wheel arrangement 21 can be moved forward in the advance direction at least temporarily by means of the adjusting means 30 so that an obliquely running removal surface can be produced.

In the interior of the guide pole 70 a conveyor line 71 can be provided which is in line connection with a discharge means 72. Via this conveyor line 71 ground material that is removed by means of the cutting wheel arrangements 21 and 22 can be discharged.

As can be gathered from FIGS. 2 and 3 in particular, the first cutting wheels 23 have cutting teeth 51 and the second cutting wheels 24 have cutting teeth 52. These cutting teeth 51 and 52 are designed such that on rotation the cutting wheel arrangements 21 and 22 cut in the same cutting direction. In the illustrated embodiment the cutting teeth 51, 52 are configured such that in the side view of FIGS. 2 and 3 the cutting wheels 23, 23', 24, 24' all cut in the clockwise direction during rotation. The cutting direction is chosen such that on rotation in the cutting direction the cutting wheels 23, 24 convey the removed ground material on their underside towards the guide side 3 and therefore towards the guide pole 70 (hence, towards the left in the illustrated embodiment). Consequently, the cutting wheels 23, 23', 24, 24' not only loosen the in-situ ground material but at the same time they convey the material towards the guide pole 70 and therefore towards the conveyor line 71.

During operation of the trench wall cutter 1 the cutting wheels 23, 23', 24, 24' are all set into a unidirectional rotation and the trench wall cutter 1 is introduced along the guide pole 70 into the ground 5. In doing so, the cutting wheels 23, 23', 24, 24' remove in-situ ground material and convey this at the same time towards the guide pole 70 where the ground material is discharged via the conveyor line 71.

For the production of an oblique removal cross-section provision can be made that through extension of the first flap 41 and the second flap 42 the cutting frame 10 is secured temporarily against a vertical movement, subsequently the hydraulic cylinder 34 of the adjusting means 30 is extended and, in doing so, the first cutting wheel arrangement 21 is lowered into the direction located obliquely underneath the second cutting wheel arrangement 22.

The invention claimed is:

1. A cutting device for producing vertically running trenches in the ground, comprising:

a trench wall cutter which includes:

a cutting frame, an auxiliary frame movably connected to the cutting frame, a first cutting wheel arrangement connected to the movable auxiliary frame, a second cutting wheel arrangement fixedly connected to the cutting frame, and an elevation adjustment mechanism connected between the cutting frame and the auxiliary frame and configured to move the auxiliary frame with the first cutting wheel arrangement in substantially vertical direction relative the second cutting wheel arrangement so as to position the first cutting wheel arrangement in an extended position lower in elevation than the second cutting wheel arrangement which is fixedly connected to the cutting frame, wherein elevation adjustment mechanism is configured to arrange the first and second cutting wheel arrangements adjacent to each other and on a substantially same elevation on the underside of the cutting frame when the first cutting wheel arrangement in a non-extended position.

2. The cutting device according to claim 1, wherein the elevation adjustment mechanism has two parallel running steering bars, through which the auxiliary frame with the first cutting wheel arrangement is connected to the cutting frame.

3. The cutting device according to claim 1 further comprises a guide pole, wherein the cutting frame has a guide side having at least one guide member for guiding the cutting frame on the guide pole.

4. The cutting device according to claim 3, wherein the guide has at least two guide shoes arranged on top of each other.

5. The cutting device according to claim 3, wherein the adjustable first cutting wheel arrangement is arranged closer to the guide side than the second cutting wheel arrangement.

6. The cutting device according to claim 3, wherein the guide pole, on which the trench wall cutter is guided, has at least one conveyor line for conveying ground material that is removed by the first and second cutting wheel arrangements.

7. The cutting device according to claim 1, wherein the first cutting wheel arrangement has at least one first cutting wheel and the second cutting wheel arrangement has at least one second cutting wheel, whereby the first cutting wheel and the second cutting wheel have the same cutting direction.

8. The cutting device according to claim 3, wherein on rotation in the cutting direction the cutting wheels convey ground material on their underside towards the guide side.

9. The cutting device according to claim 1, wherein the trench wall cutter is suspended on a cable suspension.

10. The cutting device according to claim 1, wherein the elevation adjustment mechanism has at least one hydraulic cylinder, which is articulated on the cutting frame and on the auxiliary frame having the first cutting wheel arrangement.

11. The cutting device according to claim 1, wherein on the cutting frame at least one extendable flap for securing the trench wall cutter on a wall of the trench is provided.

12. The cutting device according to claim 11, wherein the extendable flap is connected to the cutting frame via two parallel running flap steering bars.

13. The cutting device according to claim 11, wherein at least two extendable flaps for securing the trench wall cutter on a wall of the trench are provided, whereby both flaps are extendable in directions running perpendicularly to each other.

14. A method for producing a vertically running trench in the ground, wherein the cutting wheel arrangements of the trench wall cutter of a cutting device according to claim 1 are put into operation and the trench wall cutter is introduced into the ground.

* * * * *